US009114299B2

(12) United States Patent
Higgins

(10) Patent No.: US 9,114,299 B2
(45) Date of Patent: Aug. 25, 2015

(54) MUSCLE CONDITIONING APPARATUS

(76) Inventor: Douglas Alasdair Goodwin Higgins, London (GB)

( * ) Notice: Subject to any disclaimer, the term of this patent is extended or adjusted under 35 U.S.C. 154(b) by 0 days.

(21) Appl. No.: 13/149,288

(22) Filed: May 31, 2011

(65) Prior Publication Data

US 2011/0306470 A1 Dec. 15, 2011

Related U.S. Application Data

(63) Continuation of application No. 12/374,332, filed as application No. PCT/GB2007/002746 on Jul. 19, 2007, now abandoned.

(30) Foreign Application Priority Data

Jul. 19, 2006 (GB) ..... 0614288.9

(51) Int. Cl.

| | |
|---|---|
| ***A63B 21/00*** | (2006.01) |
| ***A63B 23/00*** | (2006.01) |
| ***A63B 23/02*** | (2006.01) |
| ***A63B 69/34*** | (2006.01) |
| ***A63B 23/025*** | (2006.01) |
| *A63B 21/062* | (2006.01) |

(52) U.S. Cl.

CPC ..... *A63B 69/345* (2013.01); *A63B 21/1407* (2013.01); *A63B 21/1488* (2013.01); *A63B 23/025* (2013.01); *A63B 21/062* (2013.01); *A63B 2243/0066* (2013.01)

(58) Field of Classification Search

CPC .... A63B 26/00; A63B 21/1492; A63B 23/12; A63B 22/0089; A63B 21/1415; A63B 23/0238

USPC ..... 482/92–94, 97–103, 121–122, 123, 482/137, 139, 142; 473/438, 441, 445

See application file for complete search history.

(56) References Cited

U.S. PATENT DOCUMENTS

| | | | | |
|---|---|---|---|---|
| 3,216,724 | A | 7/1963 | Williams | |
| 3,425,692 | A * | 2/1969 | Leach | 473/445 |
| 4,087,089 | A * | 5/1978 | Forrest | 473/445 |
| 4,583,731 | A * | 4/1986 | Crivello et al. | 482/138 |

(Continued)

FOREIGN PATENT DOCUMENTS

| | | |
|---|---|---|
| DE | 29619251 | 1/1997 |
| FR | 2861313 | 4/2005 |

(Continued)

OTHER PUBLICATIONS

International Search Report for corresponding application No. PCT/GB2007/002746 dated Oct. 10, 2007.

*Primary Examiner* — Loan H Thanh
*Assistant Examiner* — Andrew S Lo
(74) *Attorney, Agent, or Firm* — Renner, Otto, Boisselle & Sklar, LLP

(57) ABSTRACT

An apparatus for muscle conditioning comprises a supporting body, a hood-shaped pad, moveable relative to the body, and resistive means in the form of a weight stack and suspension mechanism. The weight stack is coupled to the hood-shaped pad via the suspension mechanism, such that a resistive force can be applied against movement of the hood-shaped pad from a first position relative to the body to a second position relative to the body. The apparatus enables the conditioning of the muscles required for successful rugby scrummaging.

7 Claims, 8 Drawing Sheets

(56) References Cited

U.S. PATENT DOCUMENTS

| | | | | | |
|---|---|---|---|---|---|
| 4,720,103 | A | | 1/1988 | Palladino, Jr. | |
| 4,722,522 | A | * | 2/1988 | Lundgren | 482/97 |
| 4,768,779 | A | * | 9/1988 | Oehman et al. | 482/10 |
| 4,844,459 | A | * | 7/1989 | Francis et al. | 473/445 |
| 5,324,247 | A | | 6/1994 | Lepley | |
| 5,360,383 | A | | 11/1994 | Boren | |
| 5,474,290 | A | * | 12/1995 | Rascona et al. | 473/441 |
| 5,618,250 | A | | 4/1997 | Butz | |
| 5,743,821 | A | * | 4/1998 | Wirachowski | 473/441 |
| 6,059,701 | A | * | 5/2000 | George et al. | 482/137 |
| 6,354,982 | B1 | | 3/2002 | Sencil | |
| 6,387,024 | B1 | * | 5/2002 | Monti et al. | 482/142 |
| 6,454,680 | B1 | | 9/2002 | Taimela | |
| 6,802,800 | B1 | * | 10/2004 | Hobson | 482/97 |
| 7,029,426 | B1 | * | 4/2006 | Fuller, Sr. | 482/97 |
| 2003/0158003 | A1 | * | 8/2003 | Corkhill | 473/445 |

FOREIGN PATENT DOCUMENTS

| | | | | | |
|---|---|---|---|---|---|
| GB | 2155793 | A | * | 10/1985 | A63B 69/00 |
| GB | 2276091 | A | * | 9/1994 | A63B 69/00 |
| GB | 2301042 | | | 11/1996 | |
| GB | 2373734 | A | * | 10/2002 | A63B 69/34 |
| GB | 2007/002746 | | | 10/2007 | |
| WO | 2005077473 | | | 8/2005 | |
| ZA | 200107431 | | | 2/2002 | |

* cited by examiner

MUSCLE CONDITIONING APPARATUS

RELATED APPLICATIONS

This application is a continuation of U.S. patent application Ser. No. 12/374,332 filed on May 12, 2009 now abandoned, which is a national phase of International Application No. PCT/GB2007/002746 filed on Jul. 19, 2007, which claims priority of United Kingdom Patent Application No. 0614288.9 filed on Jul. 19, 2006.

FIELD OF THE INVENTION

This invention relates to a muscle conditioning apparatus. Particularly, but not exclusively, the invention relates to a muscle conditioning apparatus that can be used by rugby players to develop the muscles and technique required for producing an effective performance during scrummaging.

BACKGROUND TO THE INVENTION

Rugby Union is a popular team sport that is renowned for its high intensity, full contact playing style. It is a sport that requires a variety of physical characteristics including high degrees of strength expression, power and aerobic ability.

Physiologically, strength may either be isometric or isotonic. Isometric strength relates to muscular contraction against resistance, in which the length of the muscle, once contracted, remains the same. Applying a resistance at a fixed angle, such that there is no movement of the joint, can develop this type of strength. In contrast, isotonic strength relates to muscular contraction in which the muscle remains under relatively constant tension while its length changes. Thus, the muscle has a concentric phase whereby the muscle contracts and shortens, followed by an eccentric phase whereby the muscle lengthens. Raising or lowering a weight can develop this type of strength.

In order to become stronger and obtain muscular hypertrophy, whereby existing muscle fibres are enlarged, it is necessary to overload muscles by making them work beyond a level at which they are accustomed. During weight training, initial gains are primarily due to improvements in inter-muscular coordination (2-4 weeks) and then from adaptations in neural pathways (6-8 weeks). This results in an increase in the number of muscle fibres being used during the exercise and improved efficiency in the way in which they are activated. After approximately 10 weeks muscular hypertrophy becomes apparent and the greater size of the muscle fibres allows for more force to be applied during a single contraction.

Muscle fibres are classified as either Fast Twitch or Slow Twitch, depending on the speed at which they contract. Only if the load is great enough will the faster fibres be employed. Thus, in order to develop these fibres and bring about maximum gains in strength, training with heavy loads is required.

The set scrum is one of the key elements of a game of rugby and requires significant player strength. A scrum consists of eight players from either side competing against each other for possession of the ball following a minor infringement or stoppage. It is one of the few situations where players exert a sustained physical force on their opponents. Scrums form an integral part of the battle for physical and psychological supremacy over the opposition so success in this area is of great interest to coaches and players.

Three players make up the front row of the scrum (or 'pack'), and hence are the ones in contact with the opposition. The hooker is positioned in the centre of the front row with a prop (loose-head and tight-head) on either side. These players traditionally show high levels of strength, particularly in the neck and back, and are therefore well equipped to exert and withstand the large forces experienced under scrum conditions. The second row of the scrum reinforces the front row and consists of two players. The back row consists of three players, the number 8 with a flanker on either side. The back row locks the formation together to maintain the scrum's integrity.

Each team's pack forms separately approximately 1 m apart, facing towards and slightly offset from the opposing pack. The first stage of the scrum is the 'crouch and hold' whereby the players in both packs bend their knees and adopt a crouched position prior to engagement with the opposition. FIG. 1A illustrates the 'crouch and hold' position for two opposing teams. For simplicity, only one player from each pack is shown and, in this case, the loose-head prop is shown on the left with the opposing tight-head prop shown on the right.

On engagement, the packs lean towards each other and each of the front row players is required to tuck their head under the chest of their opponent. The 'engage' position is shown in FIG. 1B, for the players described above. This position results in the cervical spine, i.e. the neck, of each front row player being in a state of flexion (i.e. where the spine is bent such that the player's chin is forced towards his chest). At this stage it is impossible for two opposing players to both straighten their necks in order to adopt the desired spine-in-line position. During the engagement phase, the horizontal force ($F_Z$) exerted by each pack, is most significant, however, this force decreases rapidly after engagement. It is considered that the engagement force is a function of player mass and speed of engagement and, therefore, it can be maximised through conventional bulk training.

The next stage of a scrum involves the adoption of the correct body position for attacking. This stage is crucial for successful scrummaging and is illustrated in FIG. 1C. Thus, the attacking player manages to extend his cervical spine by forcing his head upwards into the chest of the opponent, whilst at the same time using his chest to put pressure on the back of the opponent's head. Consequently, the attacking player is able to adopt the spine-in-line body position that is required for exerting the optimal force on his opponent. As a result of the above, the defending player is forced to adopt a poor body position with extreme flexion of the cervical spine and poor thoracic spinal alignment. Thus, the defending player is severely disadvantaged for exerting any force on his opponent. Cervical torque ($T_C$), i.e. the force applied to rotate the head, is the most significant force applied during adoption of the correct body position.

Once the correct body position has been adopted, the attacking player is able to exert more force than his opponent. This stage of the scrum is called the sustained push phase and is illustrated in FIG. 1D. Thus, the attacking player uses his lower back strength and isotonic knee extension to lift and drive his opponent backwards, past the mark of the scrum. Horizontal force ($F_Z$), vertical force ($F_Y$) and cervical torque ($T_C$) are all significant during the sustained push phase.

In view of the above, the most important stage for successful scrummaging is the adoption of the correct body position immediately after engagement. In order for a player to be able to adopt the desired spine-in-line position, isotonic cervical extension strength (ICES) is required. Thus, whichever player has the greatest ICES is likely to be able to adopt this position first and immediately be at an advantage over his opposition, since the player with the correct body position can more easily exert the forces $F_Z$ and $F_Y$ that are required for pushing his opponent backwards.

The benefits of strength training in rugby are well documented and it is common practice for players of all positions and at all levels to undergo such training as part of their preparation to meet the demands of the sport. However, there is a lack of specific conditioning equipment for the players in the front row of the scrum. Much attention is paid to well-established strength training exercises such as squats and dead lifts, but usually little time is spent strengthening the more crucial muscle groups in the neck and back, especially those responsible for extension of the neck (i.e. moving the head backwards and lifting the chin off the chest). Players must be naturally strong in these areas, or must undergo 'live' scrummaging exercises over many years, to be proficient in this aspect of the game.

In addition to the above, it is commonly believed that the better prepared a player is, physically, to cope with the demands of the game, the less likely it is for him or her to suffer an injury. In rugby generally, and in particular during scrums, there have been a number of catastrophic spinal injuries, in the large part due to 'hyperflexion' (i.e. bending beyond the normal range) of the cervical spine. It is conceivable that by strengthening the muscles of the neck, players would have added protection against this mechanism of injury, and would therefore be at a reduced risk of serious injury or paralysis.

Conventional scrummaging machines are widely used by schools and rugby clubs across the globe. The most commonly used machine is an outdoor roller-type machine intended for use by the entire pack. However, there are a number of variations including sleds and fixed-frame machines whereby pads are pushed back and forth along runners held under tension by springs. Although these machines can offer modest strength gains, their primary goal is teambuilding and the coaching of individual technique.

There are also a small number of individual scrum machines, notably those manufactured by Rhino, Predator and MyoQuip. Both the Rhino and Predator machines attempt to provide a measurement of pushing strength or 'scrummaging strength' using a pneumatic system. The MyoQuip 'Scrum Truck' on the other hand, is a weight-based system that aims to develop horizontal pushing power while maintaining the body position adopted in a scrum or maul.

In addition, there are a number of more complex systems such as the Scrum Master 'International' and a system used by the French rugby club of Toulouse that is described in WO2005/044402. These systems include advanced computer control and are capable of being programmed to provide feedback to the user. In particular, the Toulouse machine includes pads arranged to receive a substantially horizontal force from the shoulders of a user and a substantially vertical force from the back of the head of a user. The pads are connected to a support frame through resistive joints such that a measurement of the force exerted on the pads can be obtained. U.S. Pat. No. 5,324,247 describes an apparatus and method for multi-axial spinal testing and rehabilitation. U.S. Pat. No. 3,216,724 describes a football practice apparatus.

It is an aim of the present invention to provide an improved muscle conditioning apparatus that will enable front row forwards in particular, to enhance their scrummaging performance.

SUMMARY OF THE INVENTION

According to a first aspect of the present invention there is provided an apparatus for muscle conditioning. The apparatus comprises a body, a head member arranged to contact a user's head, in use and a chest member arranged to contact a user's chest, in use. The head member is arranged for rotation relative to the body against a resistive torque about an axis spaced from the head member. The axis is arranged substantially transversely to the longitudinal direction of the user's spine, in use, whereby the resistive torque urges the user's head forward, and the chest member is mounted relative to the axis and restrains forward movement of the user's chest, in use, whereby movement of the user's head to counter the resistive torque predominantly exercises the cervical section of the spine.

Thus, according to this aspect of the invention, the relative arrangement of the head member and the chest member ensures that movement of the head against the resistive torque of the head member exercises the cervical section of the spine. In this way, the apparatus can be used for muscle conditioning to strengthen the necks of rugby players, as well as for the general physical exercise of others.

In the presently preferred embodiments, the head member is arranged to contact the back of a user's head, in use. However, it is also possible for the head member to contact the front of the user's head, for example the user's forehead.

The chest member may be arranged for rotation about the axis. For example, the chest member may rotate about the axis in synchronous with the head member. Typically, the axis of rotation is positioned between the chest member and the head member.

Alternatively, the chest member may be fixed relative to the axis for movement therewith. In this case, rotation of the head member about the axis will move the head member relative to the chest member.

The apparatus may be configured to accommodate translational movement of the axis. In this case, the axis about which the head member rotates may be arranged itself to move relative to the body. For example, the axis may move in a horizontal direction and/or a vertical direction. Indeed, the apparatus may be arranged such that the axis can transcribe an arcuate path.

The apparatus may be configured to accommodate translational movement of the axis against a resistive force. In this way, the apparatus is capable not only of exercising the cervical section of the spine, but also other body parts, such as the thoracic and lumbar portions of the spine or even the musculature of the legs.

The apparatus may comprise at least one cam member arranged for rotation about the axis. The cam member may comprise a connecting point spaced from the axis to which a force is applied in use of the apparatus in order to generate the resistive torque. Thus, the resistive torque may be generated by applying a force to a cam member. With such an arrangement, the resistive torque may be generated by an arrangement of weights and pulleys, for example.

The force applied to the connecting point may be the resistive force that resists translational movement of the axis. With such an arrangement, the same resistive force may be used to resist translational movement of the axis, as well as to provide the resistive torque for the head member. For example, an arrangement of a single cable and weight stack can be used to generate the resistive force to resist translational movement of the axis, as well as to provide the resistive torque for the head member. Indeed, if such a cable is arranged at an acute angle to the horizontal, a single cable can provide resistance to both vertical and horizontal movement of the axis.

The apparatus may further comprise a shoulder member arranged to contact a user's shoulders, in use. The shoulder and head members may be movable relative to the body. The apparatus may comprise resistive means coupled to the shoulder and head members for providing a resistive force against movement of the shoulder and head members from a first position relative to the body to a second position relative to the body.

This in itself is believed to be a novel configuration and thus viewed from a further aspect the invention provides: an apparatus for muscle conditioning, the apparatus comprising a body, a shoulder member arranged to contact a user's shoulders, when in use, a head member arranged to contact a user's head, when in use, the shoulder and head members being movable relative to the body; and resistive means coupled to the shoulder and head members for providing a resistive force against movement of the shoulder and head members from a first position relative to the body to a second position relative to the body; and wherein the head member is rotatable relative to the body.

Thus, viewed from this aspect, the present invention enables the conditioning of the muscles required for successful scrummaging. In particular, the apparatus allows for development of isotonic cervical extension strength (ICES) through use of the pivotable head member. Consequently, the apparatus targets the semispinalis capitus and cervicis, multifidus and splenius muscles required for front row players to adopt the correct body position for the sustained push phase of scrummaging. Conditioning of these specific muscles also helps to provide protection against hyperflexion injury of the cervical spine. Through translational movement of the second member, the apparatus also allows for the conditioning of other muscles, in particular, those in the lower back. Thus helping to stabilise the entire spine to prevent hyper mobility of spinal segments resulting in burning pain, i.e. 'stingers', and disc protrusions, i.e. 'slipped discs'.

The present invention also facilitates functional training incorporating compound multi-joint exercises. Thus, the apparatus can be used to condition the gluteus maximus and quadriceps for the isotonic knee extension required during the sustained push phase of a scrum. It can also be used to condition the calf muscles to reduce the risk of calf injury, which is the most common scrum-related injury.

Players can use the muscle conditioning apparatus of the present invention, in order to train the muscles required during a scrum, in a much shorter period of time than if reliance were placed on many years of exposure to match conditions, as is currently the case. Not only that, but the gains in strength attainable through use of the present apparatus may in fact be greater than those achievable through repeated exposure to live scrums, and therefore the present invention may enable players to perform at a higher level than was previously attainable.

Preferably, the resistive means provides a force configured to act against the rotation of the head member. Preferably, the force configured to act against the rotation of the head member is variable. Preferably, the axis of rotation of the head member is arranged to be substantially co-incident with the centre of rotation of a user's cervical spine (i.e. the C7-T1 section), when in use.

Preferably, a chest member is arranged to contact a user's trunk, when in use. This, therefore, can simulate the position of an opponent's head against the chest of a front row player. The chest member enables a user to more accurately generate the forces required in order to adopt the correct body position for the sustained push phase of a scrum. Preferably, the chest member is moveable relative to the body. Preferably, the chest member is fixedly mounted relative to the shoulder member and movable therewith.

Preferably, the shoulder member is fixedly mounted relative to the head member and rotatable therewith. Alternatively, the head member is rotatably mounted relative to the shoulder member and moveable therewith.

Preferably, the shoulder member is configured for substantially horizontal movement with respect to the ground. It will be understood that the resistive means provides a force configured to act against the horizontal movement of the shoulder member. Preferably, the force configured to act against the horizontal movement of the shoulder member is variable.

Preferably, the shoulder member is configured for substantially vertical movement with respect to the ground. It will be understood that the resistive means provides a force configured to act against the vertical movement of the shoulder member. Preferably, the force configured to act against the vertical movement of the shoulder member is variable.

Preferably, the ratio of the forces configured to act against the rotation of the head member and against the horizontal and/or vertical movement of the shoulder member is variable. Thus, the different strength requirements of the front row, second row and back row positions can be provided for.

Preferably, the resistive means comprises a weight stack and a suspension mechanism. Preferably, when a user applies a force against the shoulder and/or head members that causes movement and/or rotation of said shoulder and/or head members, the suspension mechanism causes a weight selected from the weight stack to be suspended. It will be understood that gravity acting on the suspended weight will act as a restoring or resistive force against the movement and/or rotation of said shoulder and/or head members. Selection of a greater weight will result in a larger resistive force being generated.

Preferably, the body is configured to support the apparatus on the ground. Preferably, the body includes a footplate configured to provide a surface against which the user can push in order to overcome the forces generated by the resistive means. Preferably, the footplate is configured to contact the balls of a user's feet in order to allow for conditioning of a user's calf muscles. Preferably, the resistive means forms an integral part of the body.

Preferably, the shoulder and/or head and/or chest members are padded.

Preferably, the apparatus is adjustable to suit users of all sizes.

BRIEF DESCRIPTION OF THE DRAWINGS

Embodiments of the invention will now be described, by way of example only, and with reference to the accompanying drawings, in which.

DETAILED DESCRIPTION OF CERTAIN EMBODIMENTS

Figure 1A:
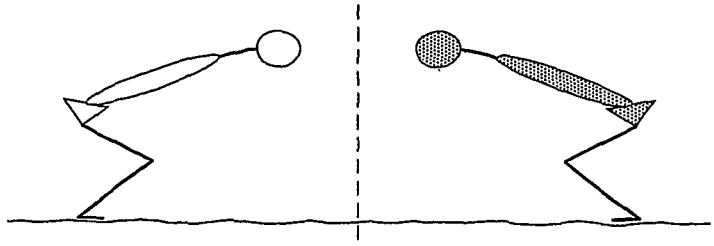
FIG. 1A illustrates schematically the crouch and hold phase of a scrum.
Figure 1B:
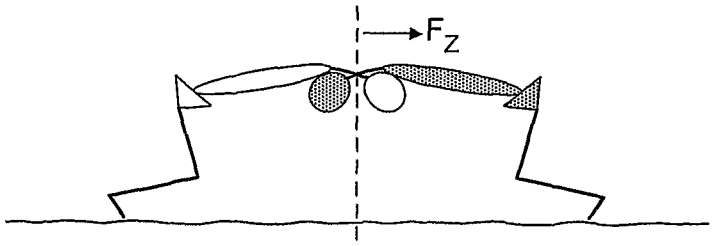
FIG. 1B illustrates schematically the engage phase of a scrum.
Figure 1C:
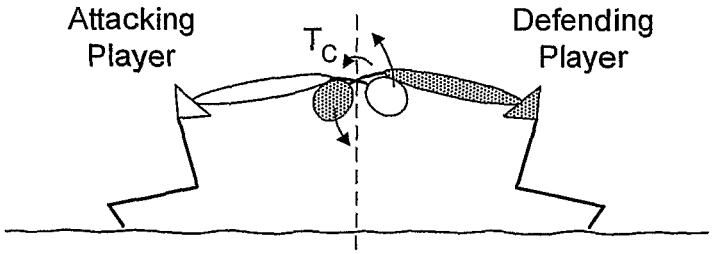
FIG. 1C illustrates schematically the adoption of the correct body position phase of a scrum.
Figure 1D:
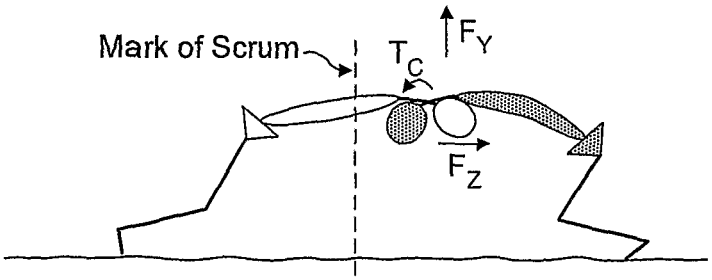
FIG. 1D illustrates schematically the sustained push phase of a scrum.

With reference to FIGS. 2 through 6C, there is illustrated a muscle conditioning apparatus 10 according to the present invention. The apparatus 10 comprises a supporting body 12, a hood-shaped pad 14, moveable relative to the body 12, and resistive means in the form of a weight stack 16 and suspension mechanism 18. The weight stack 16 is coupled to the hood-shaped pad 14 via the suspension mechanism 18, such that a resistive force can be applied against movement of the hood-shaped pad 14 from a first position relative to the body 12 to a second position relative to the body 12.

The hood-shaped pad 14 is constructed from a metal frame that is surrounded by foam and covered in leather. In an alternative embodiment a synthetic material covers the foam.

The hood-shaped pad 14 has a first portion (shoulder member) 20 that is substantially U-shaped and is configured such that its opening 22 allows a user's head and neck to be inserted therethrough in order that the user's shoulders can abut the front surfaces of its opposing sides 24 with the user facing in the same general direction as the opening 22. In use, the portion 20 is orientated so that the opening 22 faces substantially towards the ground. The hood-shaped pad 14 also includes a second portion (member) 26 that is also substantially U-shaped and which extends generally horizontally from the rear surface of the first portion 20. The second portion 26 has its opening 28 orientated in the same general direction as the opening 22 of the first portion 20. However, the second portion 26 has shallower sides 30 than the sides 24 of the first portion 20. Thus, the second portion 26 is configured such that when a user's shoulders abut the front surfaces of sides 24, the back of the user's head abuts the underside of the U-shaped crest of the second portion 26.

A third (chest) member in the form of a padded bar 32 depends from the sides 24 of the hood-shaped pad 14. The padded bar 32 is orientated substantially horizontally to the ground and is held in a fixed position relative to the hood-shaped pad 14. It is disposed below the sides 24 and forward of the front surface of the sides 24 such that it will be in contact with a user's chest when the user has his shoulders in abutment with the first portion 20.

The hood-shaped pad 14 is rotatably mounted on a pad support structure 34 that forms part of the body 12. The pad support structure 34 is shown in detail in FIG. 4 and comprises a generally C-shaped bracket 36 disposed in a horizontal plane around the rear of the hood-shaped pad 14, that is the side of the pad 14 opposite to the surfaces 24 against which a user's shoulders abut in use. Two rotatable shafts 38 are provided with each one passing through a respective channel 40 provided in each end 42 of the bracket 36. The hood-shaped pad 14 is mounted on the inwardly facing ends of the shafts 38 and is rotatable therewith. Note, the axis of rotation (A) of the shafts 38 and hence the hood-shaped pad 14 is configured to be generally co-incident with the centre of rotation of a user's cervical spine (i.e. the C7-T1 section), when the apparatus 10 is in use. Bearings 44 are provided to allow rotation of the shafts 38 within their respective channels 40. The outwardly disposed ends 46 of the shafts 38 are each provided with a cam 48 connected to a respective cable 50. The cables 50 form part of the suspension mechanism 18 discussed in more detail below.

Two spaced apart cylindrical runners 52 extend, in a horizontal plane, from the rear of the bracket 36, that is the side of the bracket 36 opposite to the hood-shaped pad 14, towards a vertical support structure 54. The vertical support structure 54 also forms part of the body 12. The two runners 52 pass through respective channels 56 in opposite sides 58 of a substantially square support frame 60. Thus, the runners 52 are free to move back and forth through the support frame 60 as a result of substantially horizontal movement ($F_Z$) of the hood-shaped pad 14, which is communicated to the runners 52 through the bracket 36. The ends of the runners 52 that are fixed to the bracket 36 are fitted with rubber stop elements 62 to cushion any contact with the support frame 60 at the extreme limit of the range of motion of the runners 52. Bearings 64 are provided to permit the runners 52 to slide linearly within their respective channels 56, and circlips 66 are provided to limit the range of motion of the runners 52 through the channels 56.

Figure 2:
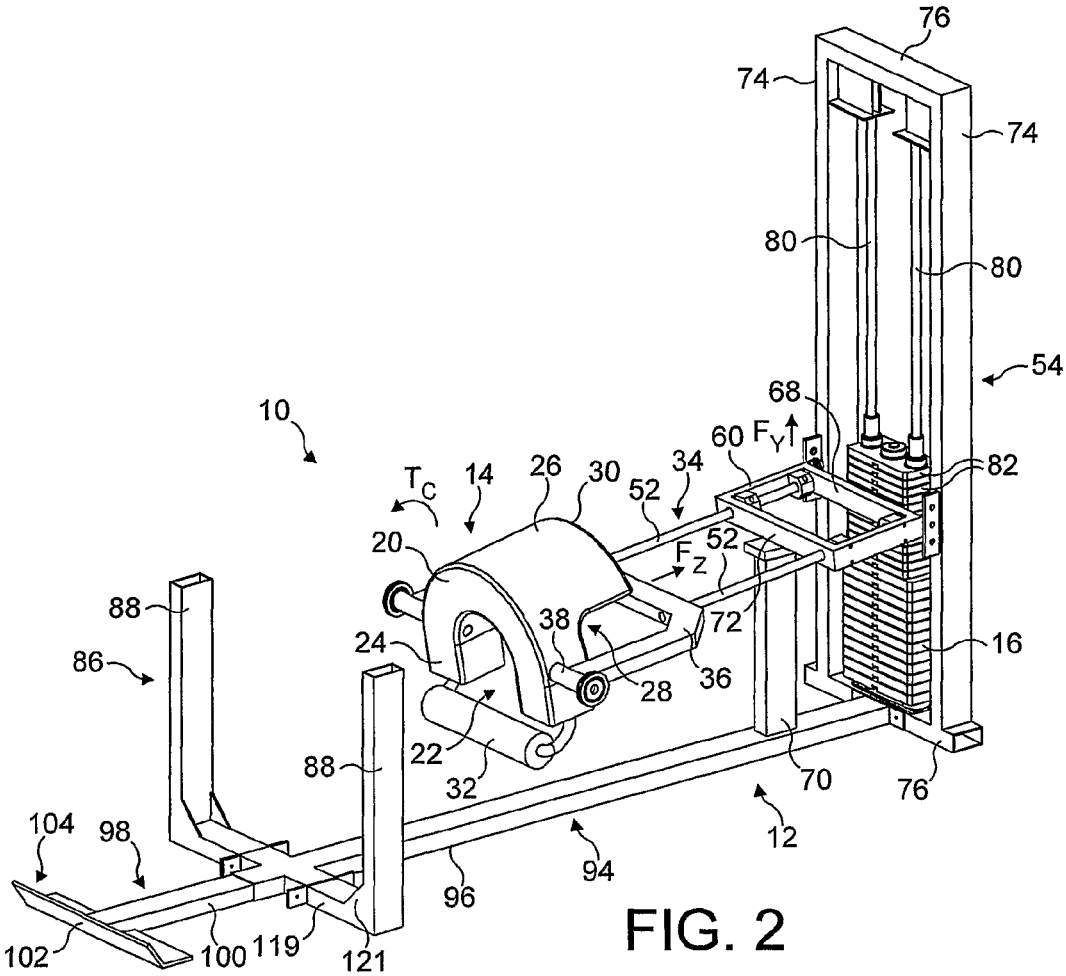
FIG. 2 illustrates a muscle conditioning apparatus, in accordance with the present invention, shown without connecting cables for simplicity.
Figure 4:
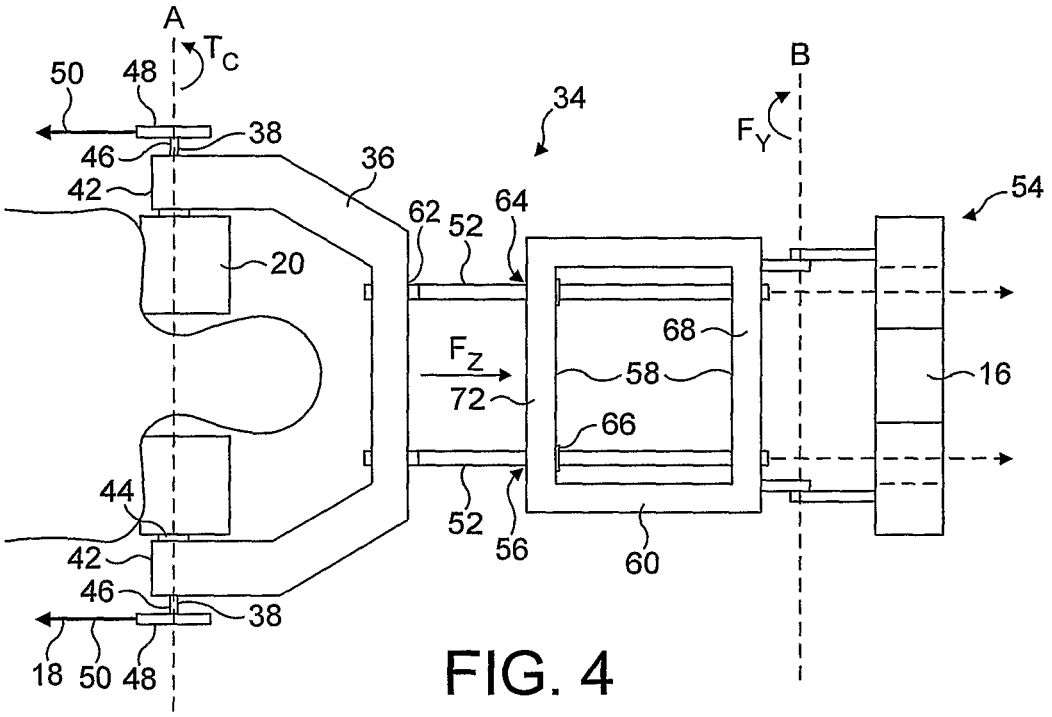
FIG. 4 illustrates a top plan view of a pad support structure of the apparatus of FIG. 2.

The support frame 60 is pivotally mounted to the vertical support structure 54, at the side 68 of the support frame 60 that is furthest from the bracket 36. Thus, as shown in FIG. 4, the entire pad support structure 34 is configured to pivot about an axis (B) adjacent to its end 68. In this particular embodiment, as shown in FIG. 2, a support member 70 is provided, beneath the side 72 of the support frame 60 that is nearest to the bracket 36, to prevent the pad support structure 34 from pivoting downwardly from a substantially horizontal rest position. Consequently, the pad support structure 34 is configured to pivot (or rotate) in an upwardly direction as indicated by the arrow $F_Y$ in FIG. 2.

The vertical support structure 54 not only supports the pad support structure 34 but also houses the weight stack 16 and suspension mechanism 18. This construction, therefore, helps to minimise space requirements as well as material and manufacturing costs. The vertical support structure 54 includes two hollow uprights 74 joined at their lower ends to a base 76 and at their upper ends to a crossbar 78. Two cylindrical metal rods 80 are disposed between the uprights 74 and extend from the base 76 to the crossbar 78. The rods 80 pass through respective cylindrical bores (not shown) in a number of rectangular metal weights 82. In a rest position, the weights 82 form a stack one on top of the other from the base 76. Each of the weights 82 is configured to slide up the rods 80 towards the crossbar 78. Selecting a weight 82 within the stack will mean that the actual weight selected includes all of the weights stacked on top of the selected weight 82.

Figure 6A:
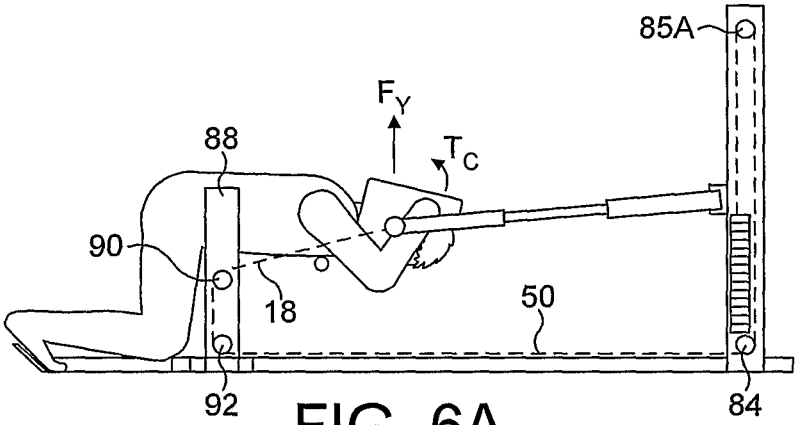
FIG. 6A illustrates use of the apparatus of FIG. 2, with a user in the initial engagement position.
Figure 7:
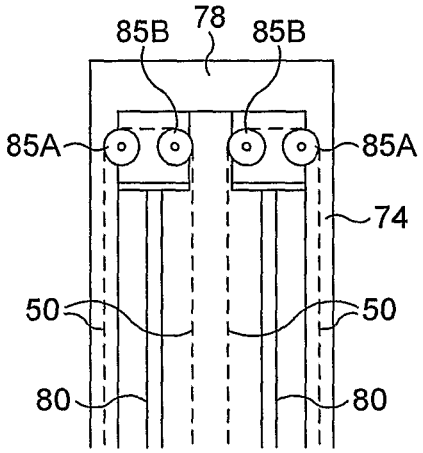
FIG. 7 illustrates a part of a pulley system of the apparatus of FIG. 2.

The suspension mechanism 18, illustrated in FIG. 6A, comprises a series of pulleys 84, 85 arranged to direct the cables 50 that are attached, via the cams 48, from the hood-shaped pad 14, to the weights 82 in such a way that movement of the hood-shaped pad results in suspension of the selected weight 82. The suspended weight 82 provides a resistive force against the movement of the hood-shaped pad 14, urging it back to its rest position. Within each upright 74 there is a lower pulley 84 positioned close to the ground and an upper pulley 85A positioned close to the crossbar 78. As shown in FIG. 7, a further pulley 85B is positioned inwardly of each upper pulley 85A in order to direct the cables 50 down the centre of the vertical support structure 54 towards the weights 82.

As shown in FIG. 2, a cable guide structure 86 is provided forwardly of the hood-shaped pad 14, on the opposite side of the hood-shaped pad 14 to the weight stack 16. The cable guide structure 86 comprises two hollow upright posts 88 positioned substantially in line with the cams 48, such that the width of a user's body can easily be accommodated between the posts 88. Within each of the posts 88 is provided an upper pulley 90 and a lower pulley 92, as illustrated in FIG. 6A. The upper pulleys 90 are positioned slightly below the height of the cam 48 and the lower pulleys 92 are positioned close to the ground.

Figure 8A:
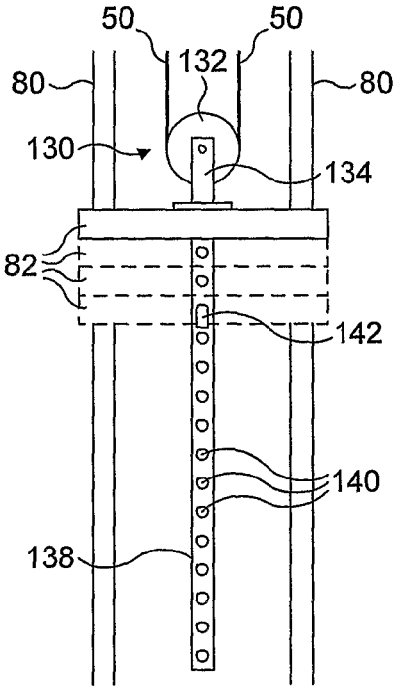
FIG. 8A illustrates a front view of a part of a suspension mechanism of the apparatus of FIG. 2.
Figure 8B:
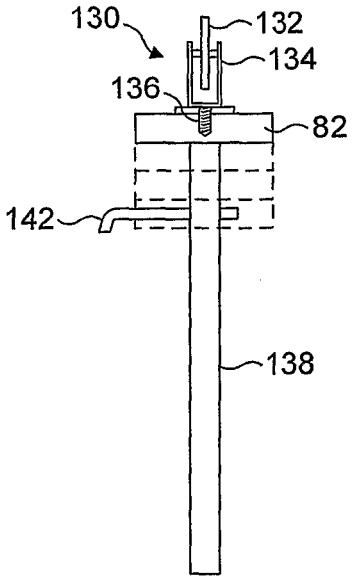
FIG. 8B illustrates a side view of the part of the suspension mechanism of FIG. 8A.

Consequently, with the above-described arrangement of pulleys, the cables 50 are directed from the cams 48 rearwardly towards the upper pulleys 90, down through the posts 88 towards the lower pulleys 92, forwardly close to the ground towards the lower pulleys 84, upwards through the uprights 74 towards the upper pulleys 85A and 85B and then downwards towards the weights 82. As shown in FIGS. 8A and 8B, a connection means 130 is provided for connecting the cable 50 to the selected weights 82. The connection means 130 comprises a pulley 132 that is attached via a bracket 134 to the uppermost weight 82 in the stack. The cable 50 is looped around the underside of the pulley 132 such that each side of the cable 50 extends between the pulley 132 and its associated upper pulley 85B. This arrangement ensures the tension on both sides of the cable 50 remains equal and therefore there is no torsion of the hood-shaped pad 14. The bracket 134 is mounted on the uppermost weight 82 via a screw-threaded bolt 136. Depending from the underside of the uppermost weight 82 is an elongate metal pole 138 provided with a series of longitudinally spaced apart through holes 140. Each weight 82 is provided with a central bore (not shown) to allow the pole 138 to move vertically up and down through the weight stack 16. Each weight 82 also has a bore (not shown) provided transversely of the central bore such that in a rest position, i.e. with all weights 82 bearing down on the stack 16, the transverse bore in each weight 82 aligns with a corresponding hole 140 in the pole 138. A metal pin 142 may then be inserted though the selected weight 82 and through the hole 140. Consequently, as the pulley 132 is raised from its rest position it draws with it the pole 138 and all weights 82 above and including the one though which the pin 142 is passed. The weights 82 below that selected by the pin 142 remain stationary and the pole 138 slides vertically through their centre.

Figure 6B:
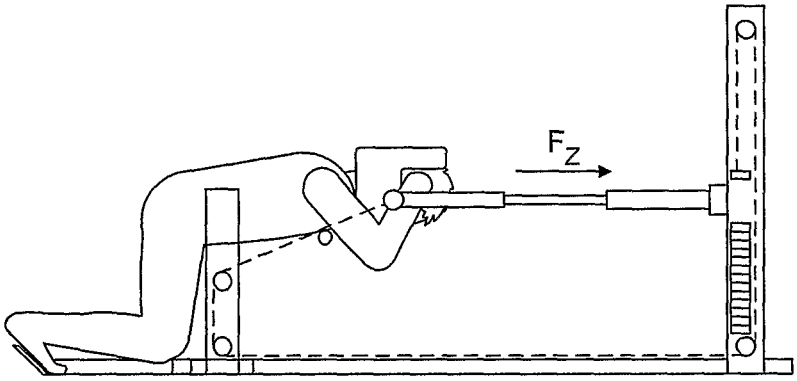
FIG. 6B illustrates use of the apparatus of FIG. 2, with a user having adopted the correct body position.

As the hood-shaped pad 14 is forced forwardly in a substantially horizontal direction indicated by the arrow $F_Z$ in FIG. 6B, the cables 50 will be placed under tension such that further forward movement will lift the weight 82 from the stack. Similarly, rotation of the hood-shaped pad 14 in the direction indicated by the arrow $T_C$ in FIG. 6A, due to a user extending his neck, will, due to the cam 48 constructions described below, also result in tension being applied to the cables 50 and subsequent lifting of the weight 82. In addition, rotation of the pad support structure 34 about axis (B), in the direction of the arrow $F_Y$ in FIG. 4, will also result in tension being applied to the cables 50 and subsequent lifting of the weight 82. Substantially vertical movement of the hood-shaped pad 14 will cause rotation in the $F_Y$ direction, as illustrated in FIG. 6A.

Figure 9A:
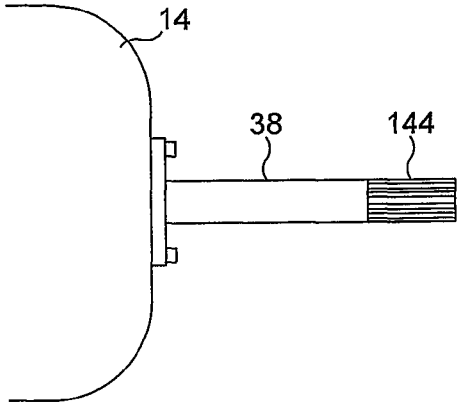
FIG. 9A illustrates a side view of a camshaft of the apparatus of FIG. 2.
Figure 9B:
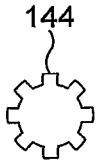
FIG. 9B illustrates an end view of the camshaft of FIG. 9A.
Figure 9C:
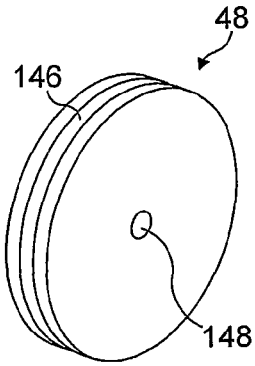
FIG. 9C illustrates a perspective view of a cam of the apparatus of FIG. 2.
Figure 9D:
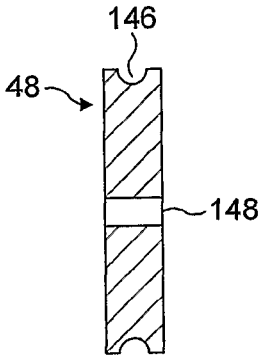
FIG. 9D illustrates a side cross-sectional view of the cam of FIG. 9C.
Figure 10:
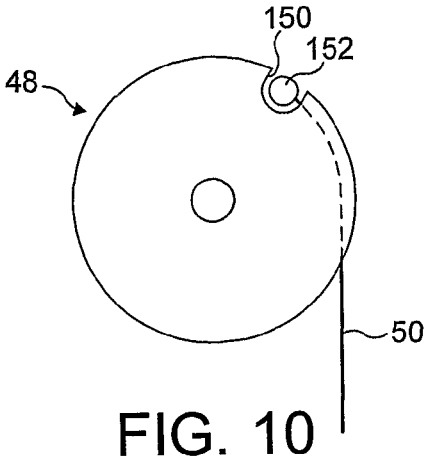
FIG. 10 illustrates a fixed cable attachment to a cam of FIG. 2.
Figure 11A:
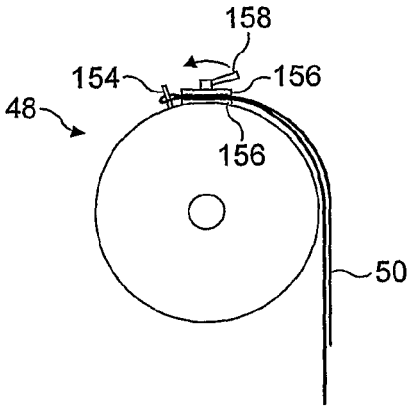
FIG. 11A illustrates an end view of an adjustable cable attachment to a cam of FIG. 2.
Figure 11B:
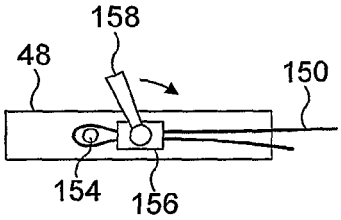
FIG. 11B illustrates a top plan view of the adjustable cable attachment of FIG. 11A.

The basic construction of each cam 48 is illustrated in FIGS. 9A through 9D. FIG. 9A shows one side of the hood-shaped pad 14 with attached shaft 38. The shaft 38 has a splined end 144 which is shown in end elevation in FIG. 9B. FIG. 9C shows a plastic circular cam 48 that has a groove 146 around its perimeter edge. The cam 48 has central bore 148 configured for complimentary engagement with the splined end 144 of the shaft 38. FIG. 9D shows a side cross-sectional view of the cam 48. The cam 48 is slid onto the splined end 144 and secured with a circlip (not shown). FIG. 10 shows more detail of one of the cams 48 employed on the apparatus 10. In addition to the above, this cam 48 includes a transverse groove 150 configured for receiving a metal pin 152 that is attached to the end of the cable 50. The pin 152 is attached to the cable 50 to form a T-shaped end so that the pin 152 is parallel to the axis of the cam 48 when placed in the groove 150. FIGS. 11A and 11B show further details of the other of the cams 48 employed in the apparatus 10. In this construction, the cable 50 is wrapped around a post 154 extending radially from the cam 48 and then clamped between two opposed metal plates 156. A threaded lever 158 is provided for opening and closing the distance between the two plates 156. Thus, the length of the cable 50 can be adjusted by moving the plates 156 apart and pulling more of the cable 50 around the post 154 before re-clamping the cable 50 in place.

Figure 5:
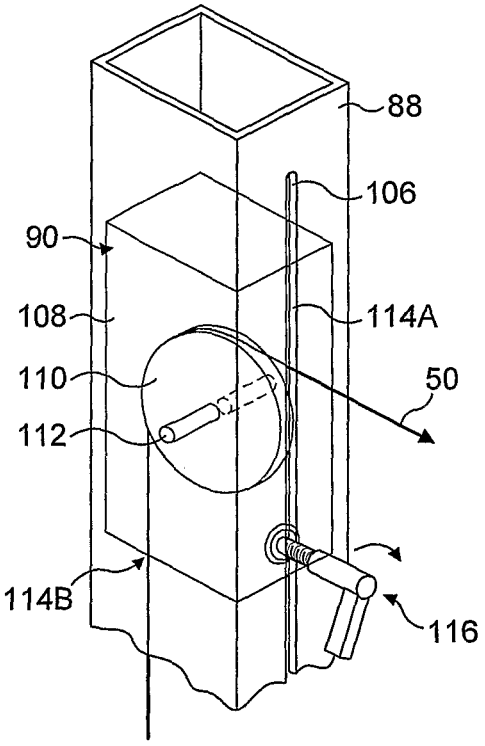
FIG. 5 illustrates a part transparent view of an adjustable pulley mechanism of the apparatus of FIG. 2.

A preferred construction for the pulleys 90 and posts 88 is shown in FIG. 5. Thus, the posts 88 are provided with a narrow longitudinal slit 106, which is configured to permit passage of the cables 50 therethrough. The pulleys 90 are arranged within a box-shaped housing 108 that is free to slide up and down within the posts 88. The pulley wheel 110 is positioned in the centre of the housing 108 and is rotatable about a shaft 112 extending between the sides of the housing 108. Holes 114A and 114B are provided in the housing 108 to allow the cable 50 to enter the housing 108 through hole 114A disposed adjacent to the longitudinal slit 106, and to leave the housing via hole 114B in the bottom of the housing 108, so that it may travel along the post 88 and/or upright 74. The housing 108 can be fixed to the post 88 by means of a screw-clamp mechanism 116, which is attached to the housing 108 and extends through the longitudinal slit 106. Thus, the heights of the pulleys 90 can be adjusted simply by clamping the pulley housings 108 at different positions along the length of the post 88. This particular construction minimises any strength reduction in the post 88 by using the same longitudinal slit 106 for the cable 50 and the clamping mechanism 116. In an alternative embodiment, pulleys 84, 85 and 92 may also be adjustable.

The body 12 also includes a ground support structure 94, as shown in FIG. 2, to support the apparatus 10 and maintain its integrity. The ground support structure 94 comprises a metal ground plate 96 formed from an elongate hollow rectangular box. One end of the ground plate 96 is secured to the base 76 of the vertical support structure 54. The other end of the ground plate 96 is provided an adjustable footplate mechanism 98. The adjustable footplate mechanism 98 comprises an extendable metal member 100, one end of which is cooperatively sized for telescopic sliding engagement within the ground plate 96. A shown in FIG. 3, the extendable member 100 is provided with a series of longitudinally spaced apart holes 101 that can be aligned with a single hole 103 provided near the end of the ground plate 96. A spring-loaded bolt 105 is provided which can be inserted through the hole 103 and through a selected hole 101 in the extendable member 100, in order to hold the member 100 in the desired position. A metal footplate 102 extends laterally from the free end of the extendable member 100 so as to form a 'T' shaped construction when viewed from above. The head of the footplate 102 comprises an upstanding substantially planar surface 104 disposed at an obtuse angle from the top surface of the ground plate 96. Thus, the footplate 102 provides a surface 104 against which a user can push with his feet, in order to generate the force required to move the hood-shaped pad 14 relative to the body 12.

Figure 3:
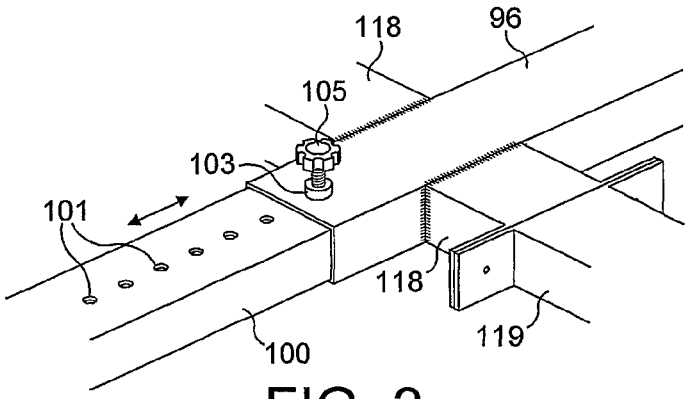
FIG. 3 illustrates an adjustable footplate mechanism of the apparatus of FIG. 2.

It is preferable that, as shown in FIG. 2, the cable guide structure 86 is also attached to the ground support structure 94. However, in order to allow for the adjustable footplate mechanism 98 and, in particular, for the extendable member 100 to slide freely within the ground plate 96, extension sections 118, shown in FIG. 3, are welded to the exterior of the ground plate 96 for attachment of the cable guide structure 86. The posts 88, of the cable guide structure 86 have each have a foot section 119 attached to their lower end. The foot sections 119 combine with the posts 88 to form L-shaped structures. The foot sections 119 extend inwardly towards the opposing post 88 and are attached at their free ends to the extension sections 118 of the ground plate 96. In order to minimise stress in the cable guide structure 86, the corner joint between each foot section 119 and its corresponding post 88 is provided with a substantially triangular support section 121. The support sections 121 also have the benefit of concealing the cables 50.

Figure 6C:
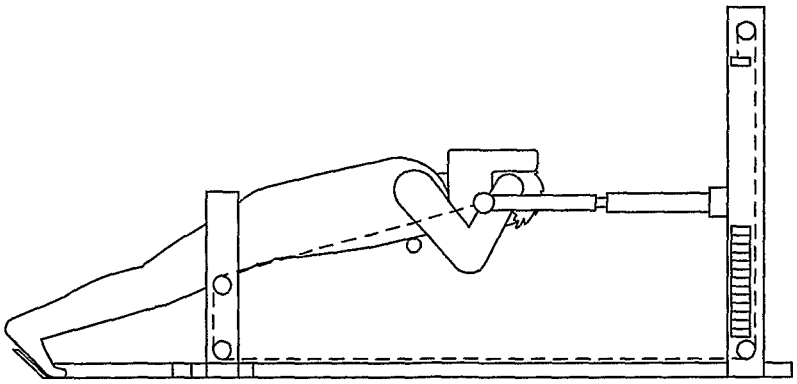
FIG. 6C illustrates use of the apparatus of FIG. 2, with a user in the sustained push position.

A typical mode of use of the apparatus 10 is shown in FIGS. 6A through 6C. Thus, a user 120 adopts the starting position by crouching down with his feet on the footplate 102 and leaning forwards placing the back of his head against the curved underside of the hood-shaped pad 14, his shoulders against the front surface 24 of the hood-shaped pad 14, and his chest against the padded bar 32. In this position, the user's cervical spine is flexed and his C7-T1 joint is slightly below his hips. This simulates the engagement position of a front row player in a scrum, as shown in FIG. 6A. To begin operation of the apparatus 10, the user 120 initially extends his cervical spine by forcing the hood-shaped pad 14 to rotate in the direction $T_C$. This movement causes the'cables 50 to tighten and lift the attached weight 82, thereby generating a resistive force against movement of the pad 14. At the same time, the user 120 uses muscles in his lumbar spine to force the pad support structure 34 slightly upwards, in a generally vertical direction, $F_Y$, so as to adopt the desired spine-in-line position whereby the user's spine is substantially parallel to the ground. Movement in the $F_Y$ direction also adds to the tension in the cables 50 and results in the suspended weight 82 being lifted higher off the stack. Thus, the user 120 has now adopted the correct body position, as shown in FIG. 6B. The next step is for the user 120 to extend his knees and push forwards with his shoulders, in the direction $F_Z$, towards the weight stack 16. This is the sustained push phase of the scrum and is illustrated in FIG. 6C. Once again, movement of the pad 14 results in further tension in the cables 50 and the weight 82 being lifted higher from the stack. Once the user has fully extended his legs, the pad 14 is returned to its start position through the reverse sequence of moves described above. This completes one cycle of the exercise. It is desirable that many repetitions of the above cycle are performed during any given training period. Note that the resistive force from the weight stack 16 is applied to the user 120 at all times when the pad 14 is not in its rest position. Consequently, force is applied throughout the entire range of motion of the exercise. Selecting a greater weight 82 will increase the resistive force applied.

In order to increase isometric strength, the user 120 could hold either the correct body position or the fully extended position for a few seconds, thereby allowing for the forces to be applied at a fixed angle.

Although, the above description has concentrated on use by a front row forward, second and back row forwards may also benefit from use of the apparatus 10. Since the second and back row players are only required to generate force in the horizontal, $F_Z$, direction, the rotation of the pad 14 in the $T_C$ direction and the movement of the pad support structure 34 in the $F_Y$ direction can be locked. Alternatively, the location of the upper pulleys 85 may be altered such that the cable 50 and runners 52 remain horizontal. Thus, training of the second and back row forwards may involve only the final knee extension stage of the above exercise, as illustrated in FIGS. 6B and 6C.

However, since it is widely accepted that conditioning of the intrinsic spinal muscles can help to prevent injury, it is advisable that all players train using all three degrees of freedom, $T_C$, $F_Y$, $F_Z$ of the apparatus 10, at least to some extent. This can form a good all-round core exercise that is likely to be more beneficial and less time-consuming than performing separate calf muscle, squat, dead lift and neck extension exercises. Since training with the apparatus 10 according to the present invention, ensures different muscle groups are exercised at the same time, it is possible that more balanced strength gains can be achieved.

Thus, the present invention provides a muscle conditioning apparatus 10 that can be used to develop the muscles required for success in a scrum. In particular, the rotation of the hood-shaped pad 14 can be used to develop the ICES which is required for a front row player to adopt the correct body position for a successful sustained push phase of a scrum.

As required for isotonic strength training, the present invention allows a substantially constant force to be applied throughout a range of motion of the user. Prior art proposals only allow for a force to be exerted by a user in a set body position and therefore can only be used to develop isometric strength.

The particular construction of the apparatus 10, described above, provides for minimal unwanted displacement of the pads 14, 32 as well as reliable and smooth runner 52 operation. In addition, the described arrangement enables the three force components, $T_C$, $F_Z$ and $F_Y$ to be coupled to only one weight stack 16.

The bracket 36 ensures that the hood-shaped pad 14 carries no loading from tension in the cables 50. It provides stability to the loading points, which is where the bracket 36 houses the camshafts 38.

With the above arrangement, the pulleys 90 can be relocated in height to vary the proportion of $F_Y$ to F.

Preferably, as in the above embodiment, cables 50 are attached to the weight stack 16 from either side of the pad 14 so as to ensure that the tension in the cables 50 is the same at each side of the pad 14 to therefore eliminate any twisting moments on the pad 14. Alternatively, a single cable may be attached to a point on an arc or cam on one side of the pad such that the pad can still rotate in the direction indicated by $T_C$.

Although the described embodiment of the invention permits rotation in the $F_Y$ direction, upwardly vertical motion of the pad 14 is all that is required. In the described embodiment, there is rotation simply due to the design of the apparatus 10, whereby the runners 52 are pivoted at one end.

In an alternative embodiment, the weight stack 16 may be positioned to the side of the body 12 and the cable 50 may be coupled directly from the pad 14 to the weight stack 16, without passing through the runners 52.

In a further embodiment, the weight stack 16 may be positioned at the centre of the runners 52 with the cables 50 feeding directly to pulleys at the rear of the runners 52 and then to the upper pulleys 85 before being attached to the weight 82. Alternatively, a single cable 50 may be employed.

In another embodiment, two or more weight stacks 16 may be employed. Thus, it will be possible to uncouple the respective forces $T_C$, $F_Y$ and $F_Z$ by providing a separate weight stack 16 for each one.

In yet a further embodiment, a counter-weight may be provided to balance the weight of the pad support structure 34. This could attach onto the frame 60 and extend behind the vertical support structure 54. This could ensure that only the vertical force ($F_Y$) experienced by the user as a result of the force provided through the cable 50, as opposed to that resulting from the weight of the pad support structure 34 itself.

In summary, an apparatus 10 for muscle conditioning comprises a supporting body 12, a hood-shaped pad 14, moveable relative to the body 12, and resistive means in the form of a weight stack 16 and suspension mechanism 18. The weight stack 16 is coupled to the hood-shaped pad 14 via the suspension mechanism 18, such that a resistive force can be applied against movement of the hood-shaped pad 14 from a first position relative to the body 12 to a second position relative to the body 12. The apparatus enables the conditioning of the muscles required for successful rugby scrummaging.

It will be appreciated by persons skilled in the art that various modifications may be made to the above-described embodiments without departing from the scope of the present invention. For example, whilst the above discussion has been concerned with use of the apparatus to develop the muscles required for successful scrummaging, the invention is equally applicable to other uses, for example, relating to muscle development for a different sport or following a particular illness or injury.

Figure 12A:
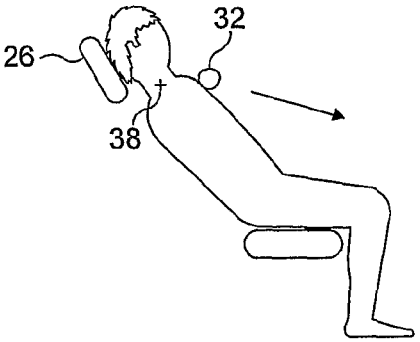
FIGS. 12A to 12C illustrate the operation of a second embodiment of the invention.
Figure 12B:
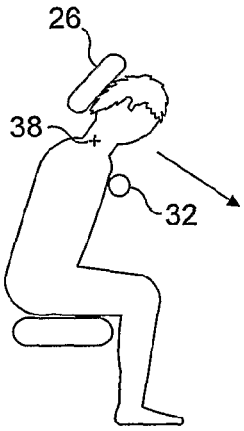
Figure 12C:
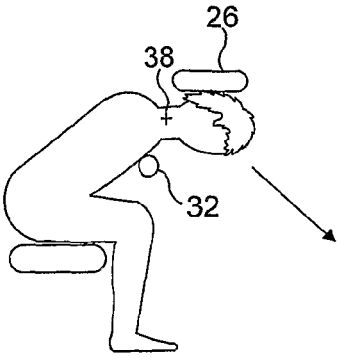

In this regard, FIGS. 12A to 12C illustrate schematically the operation of muscle conditioning apparatus according to a second embodiment of the invention suitable for general physical training. As shown in the Figures, the apparatus comprises a head member 26, arranged to rotate about an axis 38, and a chest member 32. The axis 38 is movable as indicated by the progression of positions from FIG. 12A to FIG. 12C and the head member 26 and the chest member 32 are rotatable about the axis 38. Resistance, indicated by the large arrow in FIGS. 12A to 12C is provided by a weight stack attached to a cable (not shown) as in the previous embodiment. The cable acts to urge the axis in the direction of the large arrow and by means of a cam arrangement, as described previously, provides the resistive torque for the head member 26.

The second embodiment provides a two degrees of freedom strength conditioning machine using only the degrees of freedom needed to strengthen the spine, and does not therefore include a pad that makes contact with the user's shoulders. It is therefore suited to non-contact sports where spinal injury remains an issue such as cycling, equestrian sports, gymnastics, ice-hockey and snow sports. (The large arrow indicates tension in the cable attached to the cam). The apparatus according to this embodiment is similar to current lumbar extension machines in that the user sits down then extends his or her lower back by pressing against a pad, except that the machine according to the invention replaces a single pad with a pad 26 making contact with the back of the head and a pad 32 making contact with the front of the chest below the C7-T1 section, for example at the sternum, thus generating a moment about the cervical spine. The user can then extend their spine while resistance is placed on all three sections of the spine (cervical, thoracic & lumbar) simultaneously. The axis 38 is located substantially at the C7-T1 section of the user's spine. The chest member 32 makes contact with the user's chest in a way that allows the upper (cervical) section of the spine to be isolated from the remaining lower section. Although the axis 38 does not necessarily rotate about the user's hips as the spine is a complex structure. Thus the movement of the axis 38 may take a more complex path.

Figure 13:
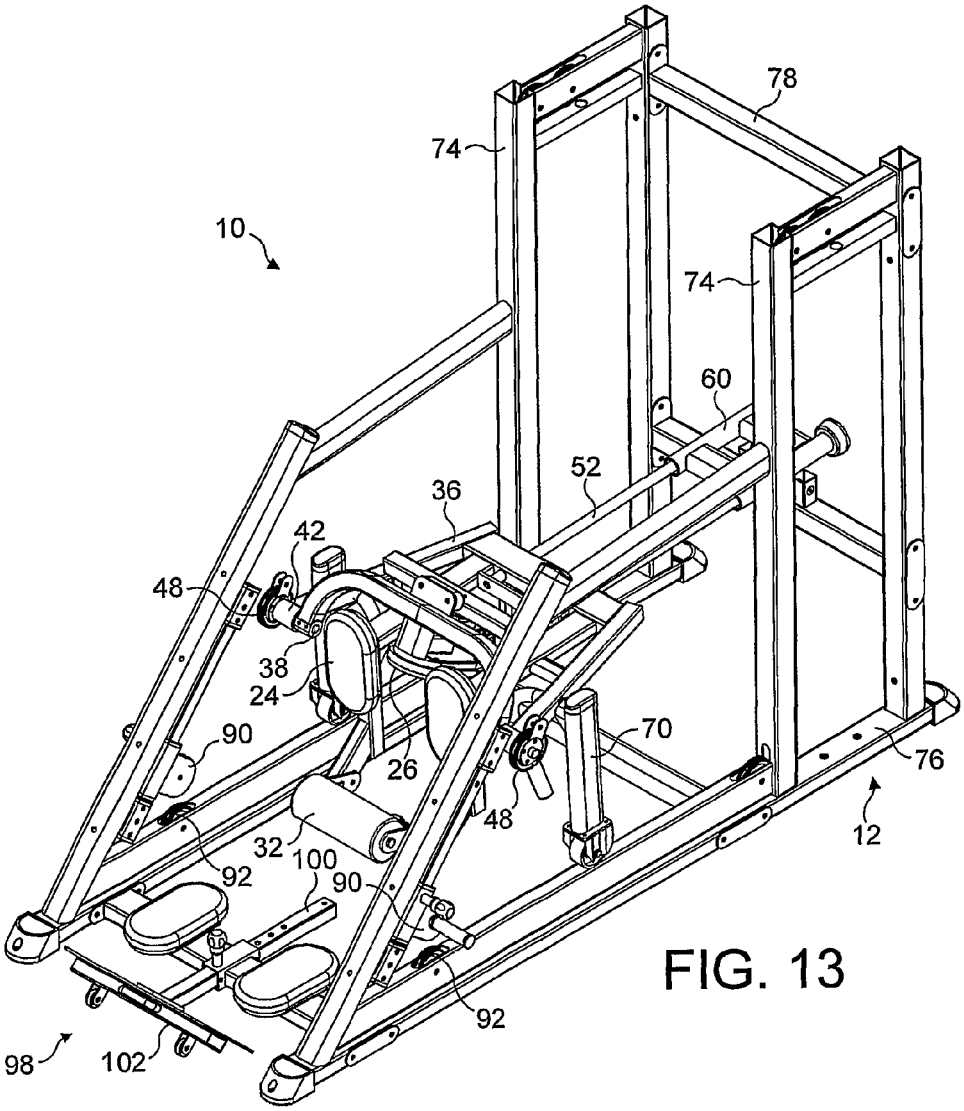
FIG. 13 is a perspective view of apparatus according to a third embodiment of the invention In the embodiments shown, corresponding reference numerals are used for corresponding components of each embodiment.

FIG. 13 shows a third embodiment of the invention intended for scrummage training. This embodiment is substantially similar to the embodiment of FIG. 2 and corresponding reference numerals have been used for corresponding parts. The points of similarity will not be described in detail and the weight stack and cables are not shown for reasons of clarity. In this arrangement, the shoulder members are provided by discrete pads 24 and the head member is also provided by a discrete pad 26, so that there is no hood-shaped pad. The chest pad 32 in this embodiment depends from the shoulder pads 24 and does not rotate about the axis 38.

The invention claimed is:

1. An apparatus for muscle conditioning comprising:

a body having a bottom surface configured for resting atop a floor;

a moveable bracket pivotally linked to the body, the moveable bracket being movable when in use by a user;

a shoulder member attached to the movable bracket and having vertical surfaces arranged to contact a user's shoulders, respectively, when the user's torso is horizontally disposed; and a downward-facing rotatable head member rotatably attached to the bracket and arranged at an underside surface thereof to contact a user's head, when the user's shoulders are in contact with the vertical surfaces of the shoulder member;

wherein resistive torque is provided about an axis spaced from the head member such that the resistive torque will urge the user's head into flexion and movement of the user's head countering the resistive torque will predominantly exercise a cervical section of the user's spine; and wherein the shoulder member comprises two shoulder contact portions laterally spaced apart for being engaged by respective shoulders of the user, with the laterally spaced apart portions defining an opening therebetween for accommodating the neck of a user when the user's head is engaged against the underside surface of the downward-facing head member; wherein the downward-facing head member is positioned between the two shoulder contact portions.

2. The apparatus according to claim 1, wherein the apparatus is configured to accommodate translational movement of the axis upon movement of the movable bracket.

3. The apparatus according to claim 2, wherein the apparatus is configured to accommodate translational movement of the axis against a resistive force, when in use.

4. The apparatus according to claim 1, wherein the head member is arranged to be substantially coincident with a centre of rotation of the user's cervical spine, when in use.

5. The apparatus according to claim 1, wherein resistive means are coupled to the shoulder and head members for providing, when in use, a resistive force against movement of the shoulder and head members from a first position relative to the body to a second position relative to the body.

6. The apparatus according to claim 1, wherein the apparatus further comprises at least one cam member arranged for rotation about the axis, the cam member comprising a connection point spaced from the axis to which a force is applied in use of the apparatus in order to generate resistive torque.

7. An apparatus for muscle conditioning comprising:

a body having a bottom surface configured for resting atop a floor;

a moveable bracket pivotally linked to the body, the moveable bracket being movable when in use by a user;

a shoulder member attached to the movable bracket and having vertical surfaces arranged to contact a user's shoulders when the user's torso is horizontally disposed; and a downward-facing rotatable head member rotatably attached to the bracket and arranged at an underside surface thereof to contact a user's head, when the user's shoulders are in contact with the vertical surfaces of the shoulder member;

wherein resistive torque is provided about an axis spaced from the head member such that the resistive torque will urge the user's head into flexion and movement of the user's head countering the resistive torque will predominantly exercise a cervical section of the user's spine; wherein the shoulder member comprises two shoulder contact portions laterally spaced apart for being engaged by respective shoulders of the user, with the laterally spaced apart portions defining an opening therebetween for accommodating the neck of a user when the user's head is engaged against the underside surface of the downward-facing head member; wherein the head member rotates relative to the shoulder member.

* * * * *